US007097122B1

(12) United States Patent
Farley

(10) Patent No.: US 7,097,122 B1
(45) Date of Patent: Aug. 29, 2006

(54) FILTERED SHOWER ARM

(76) Inventor: David K. Farley, 1827 Capital St., Corona, CA (US) 92880-1727

( * ) Notice: Subject to any disclaimer, the term of this patent is extended or adjusted under 35 U.S.C. 154(b) by 454 days.

(21) Appl. No.: 10/461,104

(22) Filed: Jun. 13, 2003

(51) Int. Cl.
*B05B 1/14* (2006.01)
*B05B 15/08* (2006.01)

(52) U.S. Cl. ..... 239/553; 239/587.1; 239/587.3; 239/587.4; 239/587.5

(58) Field of Classification Search ..... 239/553, 239/553.3, 587.1, 587.3, 587.4, 587.5, 587.6
See application file for complete search history.

(56) References Cited

U.S. PATENT DOCUMENTS

| | | | | |
|---|---|---|---|---|
| 277,203 | A | 5/1883 | Benson | 210/449 |
| 1,774,004 | A | 8/1930 | Haslett | 210/449 |
| 3,083,916 | A | 4/1963 | Neel | 239/315 |
| 3,760,951 | A | 9/1973 | Mansfield | 210/449 |
| 4,678,571 | A | 7/1987 | Hosaka et al. | 210/202 |
| 4,911,840 | A | 3/1990 | Underwood | 210/321 |
| 5,008,011 | A | 4/1991 | Underwood | 210/232 |
| 5,149,437 | A | 9/1992 | Wilkinson et al. | 210/665 |
| 5,152,464 | A | 10/1992 | Farley | 239/553.3 |
| 5,230,472 | A * | 7/1993 | McCabe | 239/443 |
| 5,300,224 | A | 4/1994 | Farley | 210/266 |
| 5,407,573 | A | 4/1995 | Hughes | 210/266 |
| 5,427,683 | A | 6/1995 | Gershon et al. | 210/264 |
| 5,503,742 | A | 4/1996 | Farley | 210/238 |
| 5,545,314 | A * | 8/1996 | Parise et al. | 210/100 |
| 5,549,822 | A | 8/1996 | Ferguson | 210/238 |
| 5,795,471 | A * | 8/1998 | Naito | 210/223 |
| 5,837,136 | A | 11/1998 | Lee | 210/207 |
| 6,016,977 | A | 1/2000 | Farley | 239/553.3 |
| 6,187,187 | B1 | 2/2001 | Farley | 210/223 |
| 6,214,224 | B1 | 4/2001 | Farley | 210/282 |
| 6,270,023 | B1 | 8/2001 | Farley | 239/553.3 |
| 6,325,930 | B1 | 12/2001 | Farley | 210/282 |
| 6,537,455 | B1 | 3/2003 | Farley | 210/251 |

* cited by examiner

*Primary Examiner*—William C. Doerrler
(74) *Attorney, Agent, or Firm*—Klein, O'Neill & Singh LLP; James G. O'Neill

(57) ABSTRACT

A combination shower arm and water filter having an integrated design for attachment between a shower wall and a showerhead. The combination shower arm and water filter includes a housing having a number of components that may be easily manipulated, and which may be connected to any available showerhead, without the need of special tools. The combination shower arm and water filter allows an attached showerhead to be extended, moved or rotated into more accessible positions by actuation of the movable portions.

20 Claims, 3 Drawing Sheets

FILTERED SHOWER ARM

BACKGROUND OF THE INVENTION

1. Field of the Invention

This invention generally relates to filtered extensions and, more particularly, to a combination shower arm and water filter that is movable to allow adjustment of a showerhead, while improving the quality of shower water.

2. Description of the Prior Art

Shower filters for use in conjunction with showerheads and filtered showerheads for use in showers are known. For example, filters are inserted at ends of shower arms, with showerheads then secured to the filters, or filtered shower heads are attached directly to the ends of the shower arms. However, because of the size of the filter and attached showerhead, and/or the filtered showerhead, they may extend too far into the shower area. Furthermore, the known filters and/or filtered showerheads add weight to the shower arm, which over time may cause problems. Additionally, the known filters and filtered showerheads are not easily adjustable, or are limited in how they may be adjusted. Such known filters and filtered showerheads also tend to be costly to manufacture and are not used by some persons because of their size or style. For example, the known filters and filtered showerheads do not always match person's aesthetic taste, and/or the overall decor of a bathroom or shower area. Finally, the known filters and filtered showerheads cannot be used with large, modern showerheads, such as the flower shaped or watering can type, and do not have an integrated feel or look when used with known shower arms.

Known shower filter and filtered showerhead assemblies are set forth in U.S. Pat. Nos. 5,152,464, 5,300,224, 5,503,742, 6,016,977, 6,187,187, 6,214,224, 6,270,023, 6,325,930 and 6,537,455 to Farley. While the foregoing prior art devices provide improved filtration of hot water passing through them, they do not provide for a filtered shower arm that may be attached or secured between a water line and a showerhead that reduces cost and weight. The device of the present invention provides an integrated articulating shower arm and filter assembly that may be used with any type of showerhead, and which also avoids the need for a separate shower filter.

Therefore, there exists a need in the art for a less, cumbersome, easy-to-install and move, lower cost combination shower arm and water filter that overcomes known problems and can be manufactured in accordance with the present invention.

SUMMARY OF THE INVENTION

Accordingly, it is a general object of the present invention to provide an improved shower filter assembly. It is a more particular object of the present invention to provide a combination shower arm and water filter. It is a further object of the present invention to provide a compact shower arm and water filter combination that takes up a minimum of space. It is yet another object of the present invention to provide a compact combined shower arm and internal water filter that may be easily used to replace an existing shower arm while offering added movement of a showerhead. It is a still further object of the present invention to provide a novel articulating filtered shower arm that may be used with a separate or integrally formed showerhead. It is yet a still further object of the present invention to provide a novel articulating filtered shower arm that has a integrated design for use with a separate or integrally formed showerhead to eliminate the need for a separate water filter and, which is more aesthetically pleasing.

In accordance with one aspect of the present invention there is provided a filtered extension comprised of a shower arm for a shower that includes a housing having movable portions with a water filter held therebetween. The combined shower arm and filter of the present invention has an integrated design, with the housing having a number of components that may be easily manipulated, and which may be used with any available showerhead, without the need of special tools.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a filtered extension comprised of a combination shower arm and water filter assembly.

The combination shower arm and water filter assembly of the present invention replaces the usual shower arm coming out of a shower wall, and is normally screwed or otherwise secured to a plumbing connection in or behind the shower wall, in the same manner as currently available shower arms.

Figure 1:
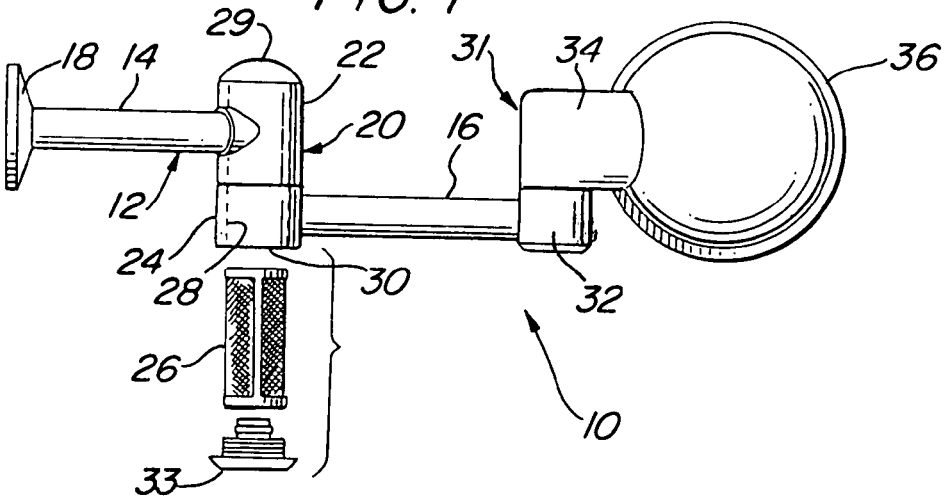
FIG. 1 is a top plan view, partially exploded, of a first embodiment of the combination shower arm and water filter assembly of the present invention.
Figure 2:
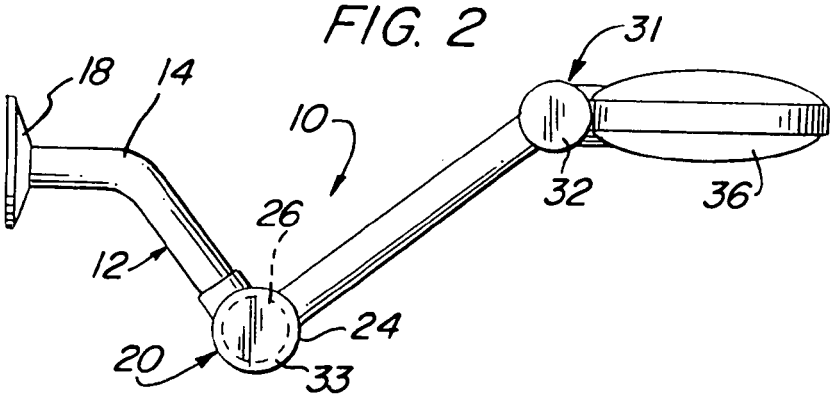
FIG. 2 is a side elevational view of FIG. 1.

Turning now to the drawings, FIGS. 1 and 2 illustrate a first embodiment of a combined shower arm and filter assembly 10 of the present invention. The combined shower arm and filter assembly 10 has a multi-component or multi-piece body or housing 12 which is used to replace the normal shower arm coming out of a shower wall, not shown.

As shown, the body 12 includes a first hollow arm 14 and a hollow second arm 16 that acts as an extension of the first arm. A wall cover 18 is shown on arm 14 at an inlet, which inlet has a threaded end, not shown, for connection to a plumbing connection in or behind a shower wall, not shown. The arms 14, 16 are movably held together in any desired manner, as by means of a holding portion or joint 20, comprising movable portions 22, 24 that allow the arms 14, 16 to move or rotate with respect to each other. The movable portions 22, 24 are preferably formed transverse or at a 90° angle to the arms 14, 16, when looking at the drawings. A water filter assembly or element 26 is removably held in a hollow chamber 28, having a closed end 29, formed between the movable portions 22, 24. An open end 30 of the hollow chamber is closed, as by means of a cap 33.

An outer or outlet end of the arm 16 includes a further joint 31 comprising a pair of movable hollow portions 32, 34 that allow a showerhead 36, formed integrally with or removably held on the portion 34 or an extension thereof, so as to be moved or rotated when the movable portions 22, 24, 32, 34 are moved with respect to each other. Therefore, it can be seen that any size or shape showerhead may be held on the combination body 12 and easily adjusted by articulating or rotating the arms 12, 14 at the joints 20, 31 formed by the movable hollow portions 22, 24, 32, 34.

In use, when the device 10 is properly mounted in a shower, water enters the inlet end of hollow arm 14 and flows into the hollow movable portion 22. Then, depending on the type of filter 26 held in the hollow chamber 28, the water flows axially or radially through the filter into hollow movable portion 24, through arm 16, movable portions 32, 34 and out through the showerhead 36. The filter 26 may be easily rotated or replaced by removing the end cap 33, to prolong the life of the filter and/or improve the efficiency of the device 10.

The combined shower arm and filter assembly of the present invention may take any number of different configurations, and examples of different embodiments thereof are described herein.

Figure 3:
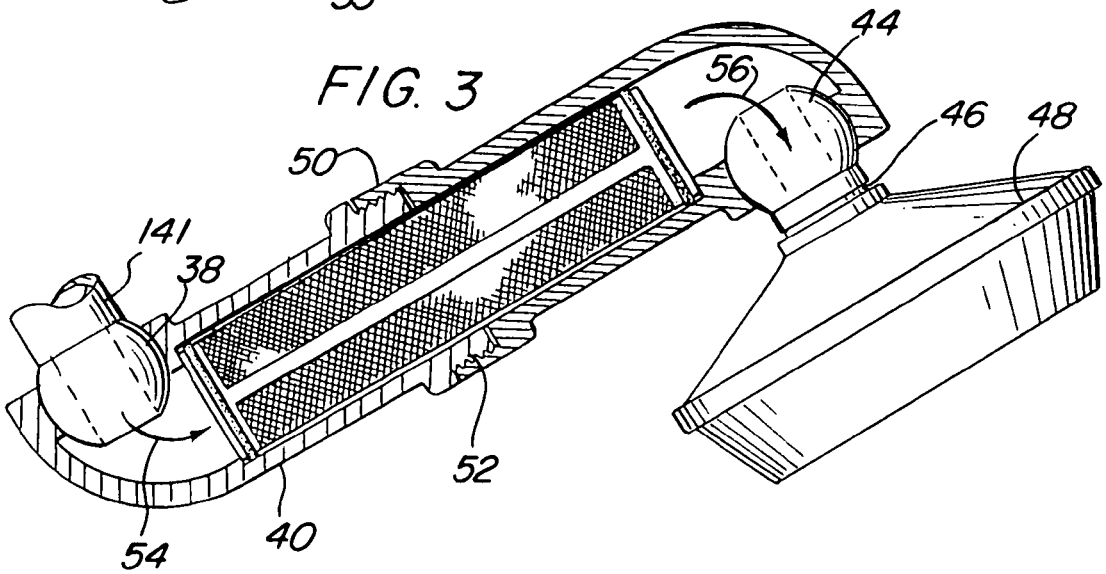
FIG. 3 is a side elevational view, partially in cross-section, of a second embodiment of the present invention.
Figure 4:
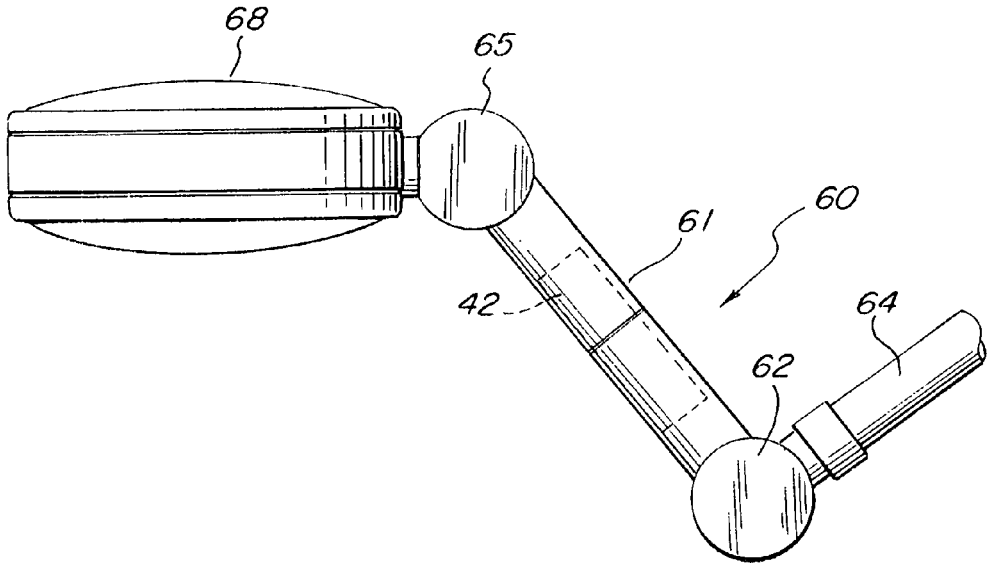
FIG. 4 is a side elevational view of a third embodiment of the present invention.
Figure 5:
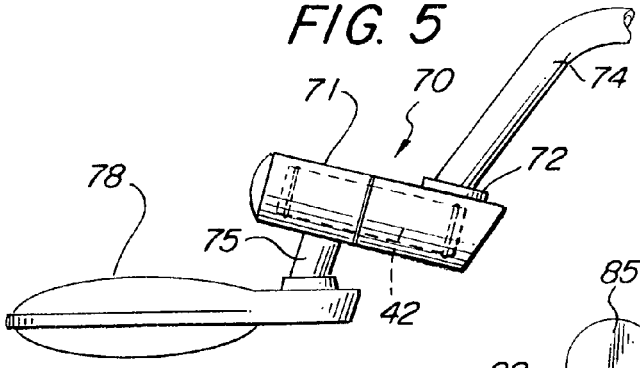
FIG. 5 is a side elevational view of a fourth embodiment of the present invention.
Figure 6:
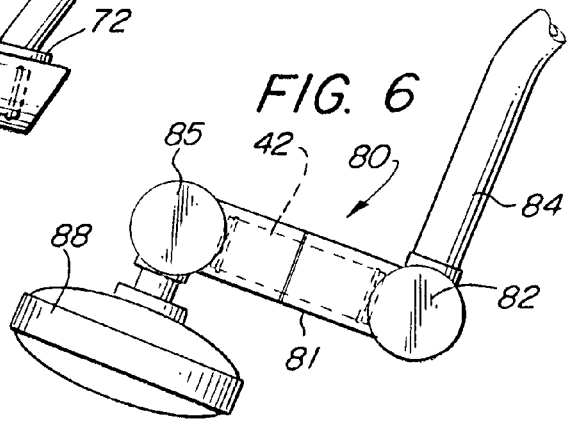
FIG. 6 is a side elevational view of a fifth embodiment of the present invention.
Figure 7:
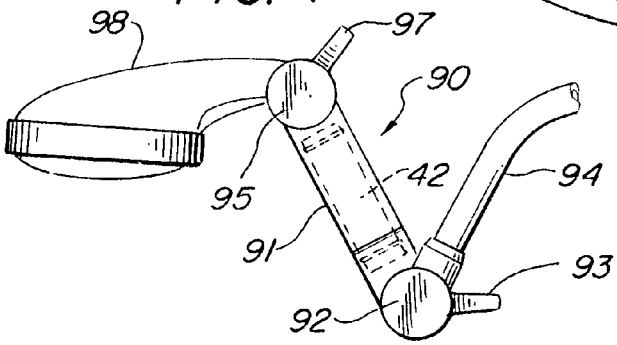
FIG. 7 is a side elevational view of a sixth embodiment of the present invention.

For example, a second embodiment of a device 37 is shown in FIG. 3. This device 37 has an arm 14' that may include a ball, swivel or other movable joint 38 connected to an arm 40 having a water filter assembly or element 42 held therein. A further ball, swivel or other movable joint 44 is connected to arm 40, after filter 42. The ball, swivel or other movable joint 44 includes an outer end 46 having a showerhead 48 formed integrally therewith, or removably mounted thereto, as by means of a threaded end. The arm 40 preferably is comprised of two portions connected or coupled together in any desired manner, for example, by externally threaded portions 50, 52, to enable the filter 42 to be easily removed for reversal or replacement.

In use, when the device 37 is properly mounted in a shower, water enters the inlet end of hollow arm 14' and flows in the direction of arrow 54 to the hollow internal portion of arm 40, axially through the filter 42 held in the arm 42, and then in the direction of arrow 56 through the ball or swivel joint 44 and out through the showerhead 48.

Third through sixth embodiments of the invention are illustrated by devices 60, 70, 80 and 90, similar to the device 37, as shown in FIGS. 4–7. These devices 60, 70, 80 and 90 have multi-piece bodies or housings comprising first arms 64, 74, 84, 94 for replacing a shower arm. The first arms 64, 74, 84, 94 end in a first ball, swivel or other movable joint 62, 72, 82, 92 connected to second arms 61, 71, 81, 91 having any desired shape or configuration with a water filter assembly or element 42 held therein. The ball, swivel or other movable joint 92 may include a finger or handle 93 to aid in moving the joint, and/or for locking the joint in a desired position.

A further or second ball, swivel or other movable joint 65, 75, 85, 95 is connected to the second arms 61, 71, 81, 91 to allow a showerhead 68, 78, 88, 98 connected thereto to be movable with respect to its respective arm 61, 71, 81, 91, while these second arms are movable with respect to first arms 64, 74, 84, 94. The ball, swivel or other movable joint 95 may also include a finger or handle 97 to aid in moving the joint, and/or for locking the joint in a desired position.

The arms 61, 71, 81, 91 may be made in one or two pieces, but are shown as being comprised of two portions connected or coupled together in any desired manner, for example, by internal or external threaded portions, to enable the filter 42 to be easily removed for reversal or replacement.

Figure 8:
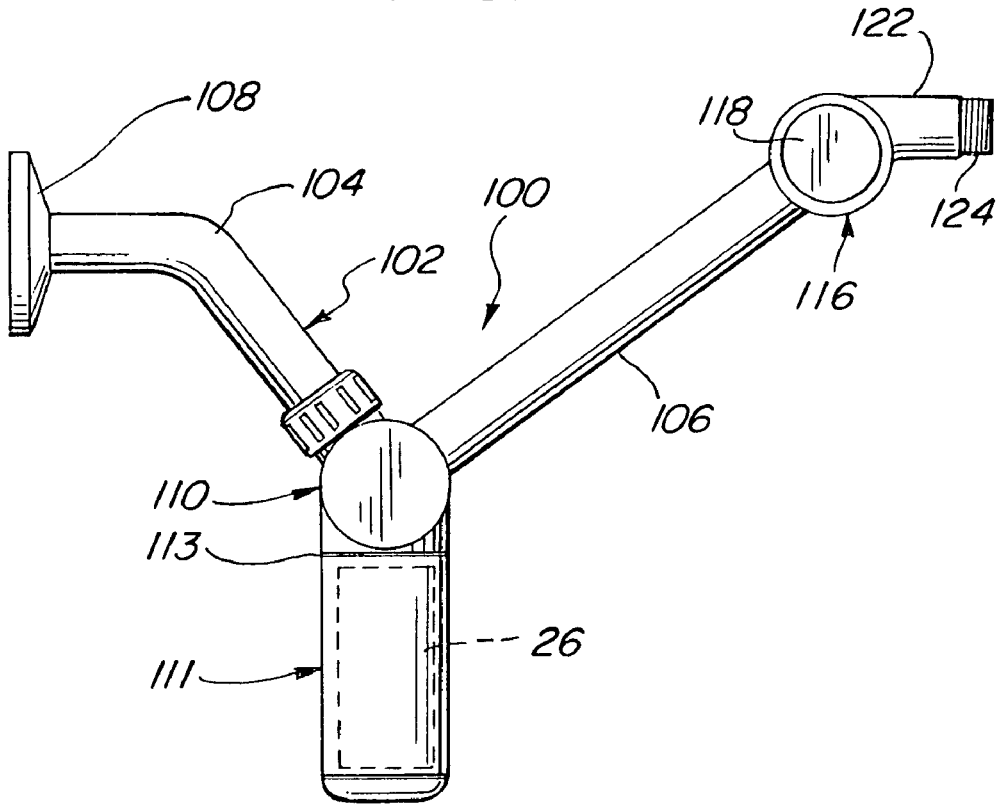
FIG. 8 is a side elevational view of a seventh embodiment of the present invention.
Figure 9:
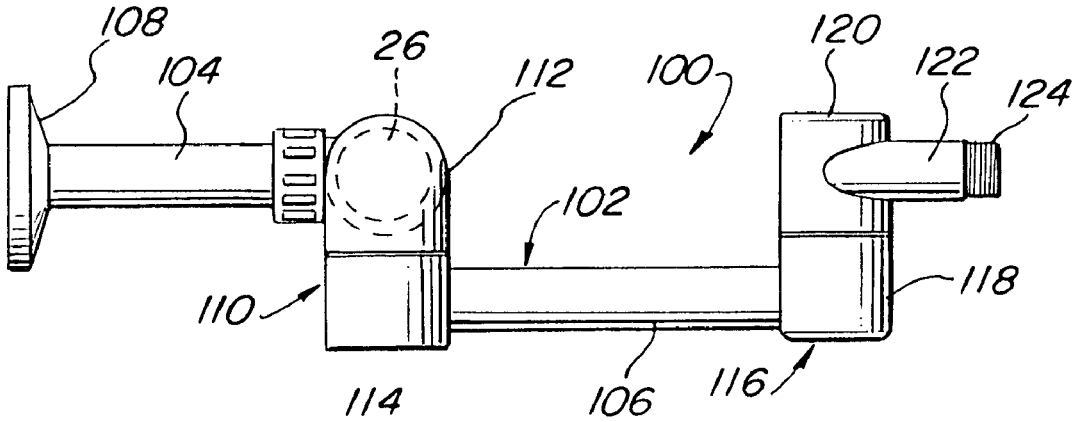
FIG. 9 is a side elevational view of FIG. 8.

Turning now to FIG. 8, there shown is seventh embodiment of a combined shower arm and filter assembly 100 of the present invention. The combined shower arm and filter assembly 100 has a multi-piece body or housing 102 which is used to replace the normal shower arm coming out of a shower wall, not shown. The body 102 includes a first hollow arm 104 and a second hollow arm 106. A wall cover 108 is shown on arm 104 at an inlet, which inlet has a threaded end, not shown, for connection to a plumbing connection in or behind a shower wall. The arms 104, 106 are movably held together in any desired manner, as by means of a holding portion or joint 110, comprising hollow movable portions 112, 114. The hollow movable portions 112, 114 allow the arms 104, 106 to move or rotate with respect to each other. The movable portions 112, 114 of the holding portion or joint 110 are preferably formed transversely to or at a 90° angle to the arms 104, 106. A filter holding portion 111 having a filter element 26 removably held in a hollow internal chamber is shown extending downwardly or outwardly from the holding portion or joint 110, and may be connected to either of the movable portions 112, 114, but is preferably fluidly connected to the movable portion 112. The filter holding portion 111 is preferably removably held to the movable portion 112, as by means of a removable connection shown at 113. Water entering the movable portion 112 must pass through the filter 26 before it enters movable portion 114.

An outer or outlet end of the arm 106 includes a further joint 116, comprised of a pair of movable hollow portions 118, 120 that allow a showerhead, not shown, to be secured to a threaded end 124 of a connecting portion 122 formed integrally with or removably held on the movable portion 120. Any size or shape showerhead may be removably held on the combination body 102 and easily adjusted by a user by articulating or rotating the arms 104, 106 at the joints 110, 116 formed by the movable hollow portions 112, 114, 118, 120.

It, therefore, can be seen that the present invention provides an improved less cumbersome, easy-to-install and move, lower cost combination shower arm and water filter having an integrated design, with a housing comprised of a number of movable components that may be easily manipulated, and which may be used with any available showerhead, without the need of special tools or adapters.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A combination shower arm and water filter, comprising;

the shower arm having a housing with a plurality of movable components comprised of at least a first hollow arm and a second hollow arm;

the first hollow arm having a first end and a second end, with the first end directly secured to a water source behind a shower wall and the second end secured to a first joint;

the second hollow arm having an inlet end and an outlet end, with the inlet end secured to the first joint and the outlet end secured to a second joint;

the second joint adapted to be secured to a further movable component; and the water filter being held in the housing.

2. A combination shower arm and water filter, comprising:

the shower arm having a housing with a plurality of movable components comprised of at least a first hollow arm and a second hollow arm;

the first hollow arm having a first end and a second end, with the first end adapted to be secured to a water source in or behind a shower wall and the second end secured to a first joint;

the second hollow arm having an inlet end and an outlet end, with the inlet end secured to the first joint and the outlet end secured to a second joint;

the second joint adapted to be secured to a further movable component; and the first joint including a hollow chamber having the water filter held therein.

3. The combination shower arm and water filter of claim 2 wherein the hollow chamber is formed transversely to the first hollow arm and the second hollow arm.

4. The combination shower arm and water filter of claim 3, further including a showerhead formed integrally with the second joint.

5. The combination shower arm and water filter of claim 3, further including a showerhead removably secured to the second joint.

6. A combination shower arm and water filter, comprising:

the shower arm having a housing with a plurality of movable components comprised of at least a first hollow arm and a second hollow arm;

the first hollow arm having a first end and a second end, with the first end adapted to be secured to a water source in or behind a shower wall and the second end secured to a first joint;

the second hollow arm having an inlet end and an outlet end, with the inlet end secured to the first joint and the outlet end secured to a second joint;

the second joint adapted to be secured to a further movable component;

the water filter being held in the second hollow arm between the first joint and the second joint.

7. The combination shower arm and water filter of claim 6, further including a showerhead formed integrally with the second joint.

8. The combination shower arm and water filter of claim 6, further including a showerhead removably secured to the second joint.

9. A combination shower arm and water filter, comprising:

the shower arm having a housing with a plurality of movable components comprised of at least a first hollow arm and a second hollow arm;

the first hollow arm having a first end and a second end, with the first end directly secured to a water source behind a shower wall and the second end secured to a first movable joint;

the second hollow arm having an inlet end and an outlet end, with the inlet end secured to the first movable joint and the outlet end secured to a second movable joint;

the second movable joint being secured to a further movable component; and the water filter being removably held in the housing.

10. A combination shower arm and water filter, comprising:

the shower arm having a housing with a plurality of movable components comprised of at least a first hollow arm and a second hollow arm;

the first hollow arm having a first end and a second end, with the first end adapted to be secured to a water source in or behind a shower wall and the second end secured to a first movable joint;

the second hollow arm having an inlet end and an outlet end, with the inlet end secured to the first movable joint and the outlet end secured to a second movable joint;

the second movable joint being secured to a further movable component; and the first movable joint including a pair of movable portions having a hollow chamber formed therein, with the water filter removably held in the hollow chamber.

11. The combination shower arm and water filter of claim 10 wherein the hollow chamber is formed transversely to the first hollow arm and the second hollow arm.

12. The combination shower arm and water filter of claim 9 wherein the water filter assembly is removably held in the second hollow arm between the first movable joint and the second movable joint.

13. A filtered extension, comprising:

a housing having a first hollow arm and a second hollow arm;

the first hollow arm having a first end and a second end, with the first end directly secured to a water source behind a shower wall and the second end secured to a first rotatable joint comprised of first and second elements;

the second hollow arm having an inlet end and an outlet end, with the inlet end secured to the first rotatable joint and the outlet end secured to a second rotatable joint comprised of first and second portions;

a showerhead secured to the second rotatable joint; and a water filter assembly removably held in the housing.

14. A filtered extension, comprising:

a housing having a first hollow arm and a second hollow arm;

the first hollow arm having a first end and a second end, with the first end adapted to be secured to a water source in or behind a shower wall and the second end secured to a first rotatable joint comprised of first and second elements;

the second hollow arm having an inlet end and an outlet end, with the inlet end secured to the first rotatable joint and the outlet end secured to a second rotatable joint comprised of first and second portions;

a showerhead secured to the second rotatable joint; and the first rotatable joint including a hollow chamber having a water filter assembly removably held therein.

15. The filtered extension of claim 14 wherein the hollow chamber is formed at 90° to the first and second elements.

16. The filtered extension of claim 15 wherein the showerhead is formed integrally with the second rotatable joint.

17. The filtered extension of claim 15 wherein the showerhead is removably secured to the second rotatable joint.

18. The filtered extension of claim 13 wherein the water filter assembly is removably held in the second hollow arm between the first rotatable joint and the second rotatable joint.

19. The filtered extension of claim 18 wherein the showerhead is formed integrally with the second rotatable joint.

20. The filtered extension of claim 18 wherein the showerhead is removably secured to the second joint.

* * * * *